US005144189A

United States Patent [19]

Van Heeswijk et al.

[11] Patent Number: 5,144,189

[45] Date of Patent: Sep. 1, 1992

[54] AUTOMOTIVE HIGH VOLTAGE DISCHARGE LIGHTING SYSTEM AND ASSEMBLY

[75] Inventors: Johannes A. A. M. Van Heeswijk; Josephus F. Rijckaert, both of Eindhoven, Netherlands

[73] Assignee: U.S. Philips Corporation, New York, N.Y.

[21] Appl. No.: 701,294

[22] Filed: May 13, 1991

Related U.S. Application Data

[63] Continuation of Ser. No. 530,486, May 30, 1990, abandoned, which is a continuation of Ser. No. 283,002, Dec. 8, 1988, abandoned, which is a continuation of Ser. No. 68,873, Jul. 1, 1987, abandoned.

[30] Foreign Application Priority Data

Mar. 6, 1987 [NL] Netherlands ..... 8700540

[51] Int. Cl.[5] ..... H01J 5/54; H01J 5/60

[52] U.S. Cl. ..... 313/51; 313/318; 315/175; 439/182

[58] Field of Search ..... 313/49, 51, 113, 318; 315/172, 125; 439/181, 182

[56] References Cited

U.S. PATENT DOCUMENTS

| | | | |
|---|---|---|---|
| 4,156,161 | 5/1979 | Pittman | 313/51 X |
| 4,255,691 | 3/1981 | Inagaki et al. | 315/241 P |
| 4,456,857 | 6/1984 | Orr et al. | 315/360 |
| 4,513,356 | 4/1985 | Mikola | 362/267 X |
| 4,533,851 | 8/1985 | Block et al. | 313/318 X |
| 4,542,316 | 9/1985 | Hall et al. | 313/622 X |
| 4,626,734 | 12/1986 | Greiler | 313/113 X |
| 4,634,920 | 1/1987 | Rijkaert et al. | 313/318 |
| 4,697,220 | 9/1987 | Chung | 315/82 X |
| 4,722,039 | 1/1988 | Gaugel | 313/113 X |
| 4,799,135 | 1/1989 | Inukai et al. | 313/113 X |

*Primary Examiner*—Donald J. Yusko
*Assistant Examiner*—Michael Horabik
*Attorney, Agent, or Firm*—Brian J. Wieghaus

[57] ABSTRACT

The assembly of a headlight and a connector has in the headlight an electric discharge lamp with a lamp cap and contacts at this lamp cap, which cap is attached by a fixing member to a reflector. The headlight has beside the lamp cap a contact member. The connector has main contacts for the lamp and additional contacts adapted to cooperate with the contact member. It is not until the contact member interconnects the additional contacts that a high voltage is applied across the main contacts of the connector.

17 Claims, 3 Drawing Sheets

AUTOMOTIVE HIGH VOLTAGE DISCHARGE LIGHTING SYSTEM AND ASSEMBLY

This is a continuation of application Ser. No. 07/530,486, filed May 30, 1990 now abandoned, which was a continuation of U.S. Pat. No. 07/283,002, filed Dec. 8, 1988 now abandoned, which was a continuation of U.S. Pat. No. 07/068,873, filed Jul. 1, 1987 now abandoned.

BACKGROUND OF THE INVENTION

The invention relates to an assembly of a headlight and a connector, in which the headlight comprises an electric lamp provided with a lamp cap and electrical conductors, which extend from the lamp to contacts at the lamp cap. A reflector is provided with an opening for receiving the lamp cap of the lamp and with fixing means arranged to surround this opening. A fixing member for fixing the lamp cap in the opening of the reflector is adapted to cooperate with the fixing means of the reflector.

The connector or socket has main contacts for connecting the lamp to a lamp circuit when the main contacts of the connector are arranged against the contacts at the lamp cap. A headlight for such an assembly is known from EP 152649 A1 to which U.S. Pat. No. 4,634,920 corresponds.

It is desirable to use a high intensity discharge lamp instead of a tungsten halogen lamp in a car headlight system. However, a discharge lamp used in the headlight lamp requires a high voltage of several kV to ignite and to produce rapidly a considerable quantity of light. It is dangerous when bare metal parts of the lamp are touched when they are applied to this high voltage. These parts could be touched if the lamp is connected via the connector to its voltage source before the lamp is arranged in the reflector. It may also be dangerous when the connector is applied to a high voltage, while it is detached from the contacts at the lamp cap, for example when the lamp is exchanged.

SUMMARY OF THE INVENTION

The invention has for its object to provide an assembly of the kind described in the opening paragraph, in which a high voltage discharge lamp is used instead of a low voltage filament lamp and in which the risk of touching electrically live bare metal parts is obviated.

According to the invention, this object is achieved in said assembly in that the connector has additional contacts adapted to be included in a low-voltage circuit feeding the lamp energizing circuit and the headlight has beside the lamp cap a contact member which electrically interconnects the additional contacts of the connector when the main contacts of the connector are arranged against the contacts at the lamp cap.

In the assembly according to the invention, the reflector or the fixing member can have a contact member which closes an electrical circuit of low voltage, for example 12 V, when the connector is arranged in a vehicle, as a result of which the lamp energizing circuit of high voltage, for example 10 kV, is excited, or enabled. Another possibility consists in that the reflector and the fixing member each have a complementary part of this contact member. When the connector is detached from the headlight, the current supply to the feeding apparatus of the headlight is therefore interrupted and the energizing circuit is disabled.

From a view point of construction, a contact member at the reflector or at the fixing member is to be preferred. Of these two possibilities, that of providing a contact member at the fixing member is easiest to realize.

In the assembly according to the invention, it is not possible to supply the discharge lamp outside the reflector with a high voltage by placing the connector or socket on the contacts of the lamp cap if the additional contacts are not intentionally interconnected by artificial means. The possibility of touching accidentally a bare conductor carrying high voltage, i.e. either a conductor of the discharge lamp or a main contact of the socket, is thus effectively obviated.

The additional contacts of the socket can form part of a switch which is closed by the contact member. The contact member can then itself be an electrical isolator.

In an attractive embodiment, however, the additional contacts are electrically interconnected by an electrically conducting contact member. The contact member is then electrically included in the circuit of which these additional contacts form part. The additional contacts may be arranged, for example, opposite to each other in the proximity one of the other so that they may be interconnected, for example, by one strip, pin or sleeve. Another possibility consists in that they are arranged at a greater relative distance so as to be spatially separated and each come into contact with their own, for example strip-, pin- or sleeve-shaped contact part of the contact member. Since a loose connector may carry a low voltage, the additional contacts are preferably arranged so as to be sunk into the connector, in the embodiment last described, for example in an individual cavity.

The assembly can be used in vehicles. The headlight of the assembly can be suitable for producing a high beam or a dipped beam or for use as a fog-lamp. The electric discharge lamp used may then be, for example, a high-pressure sodium discharge lamp or a high-pressure mercury discharge lamp with metal halide additions or a high-pressure xenon discharge lamp, as the case may be with halide additions.

The contacts at the lamp cap and the contact member may extend in the longitudinal direction of the reflector, as it is shown in the drawings, or in a direction transverse thereto. In the latter, less space longitudinally of the reflector is needed by the socket.

BRIEF DESCRIPTION OF THE DRAWING

Embodiments of the assembly according to the invention are shown in the drawings. In the drawings.

DESCRIPTION OF THE PREFERRED EMBODIMENT

Figure 1:
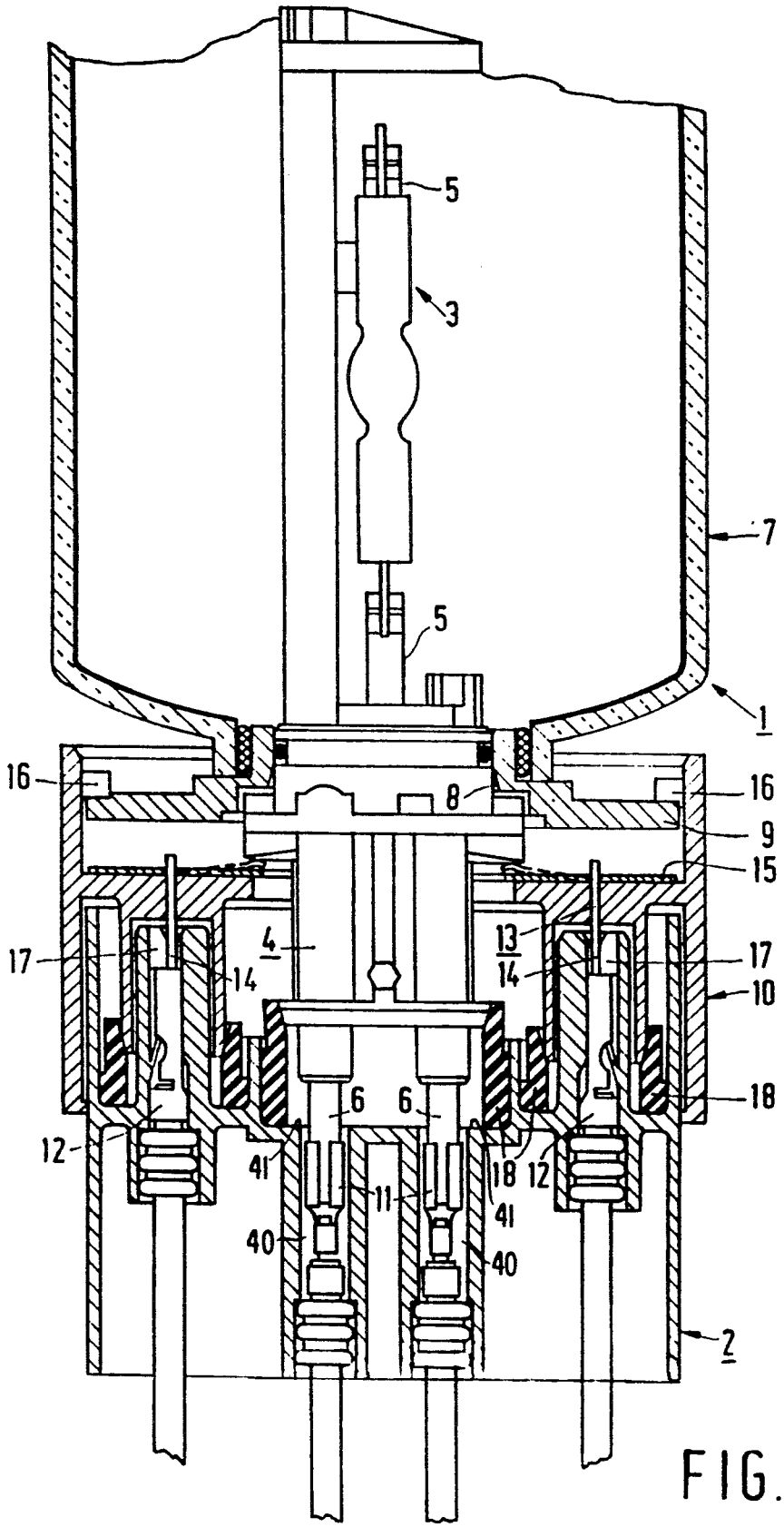
FIG. 1 is a longitudinal sectional view of a first embodiment of an assembly.

In FIG. 1, the assembly of headlight and connector comprises a headlight 1 and a connector 2.

The headlight 1 comprises an electric discharge lamp having a discharge device 3 which defines a lamp axis 50 provided with a lamp cap 4 and electrical conductors 5, which extend from the discharge device 3 to contacts 6 at the lamp cap 4.

The headlight 1 further comprises a reflector 7 having an optical axis 51 provided with an opening 8 for receiving the lamp cap 4 of the lamp and with fixing means or circular planar member 9 around this opening 8. The circular planar member 9 is an integral part of the reflector 7 in the embodiment shown.

The headlight further comprises a fixing member or body 10 for fixing the lamp cap 4 in the opening 8 of the reflector 7 to secure the lamp cap to the reflector with the lamp axis 60 aligned with the optical axis 61 of the reflector. The fixing member or body 10 is adapted to cooperate with the fixing means 9 of the reflector 7. In the embodiment shown, the body is a union nut which is arranged axially around the fixing means 9 and the lamp cap 4 and is then rotated through an angle of several degrees to an abutment stop to cooperate with the fixing means 9.

Figure 4:
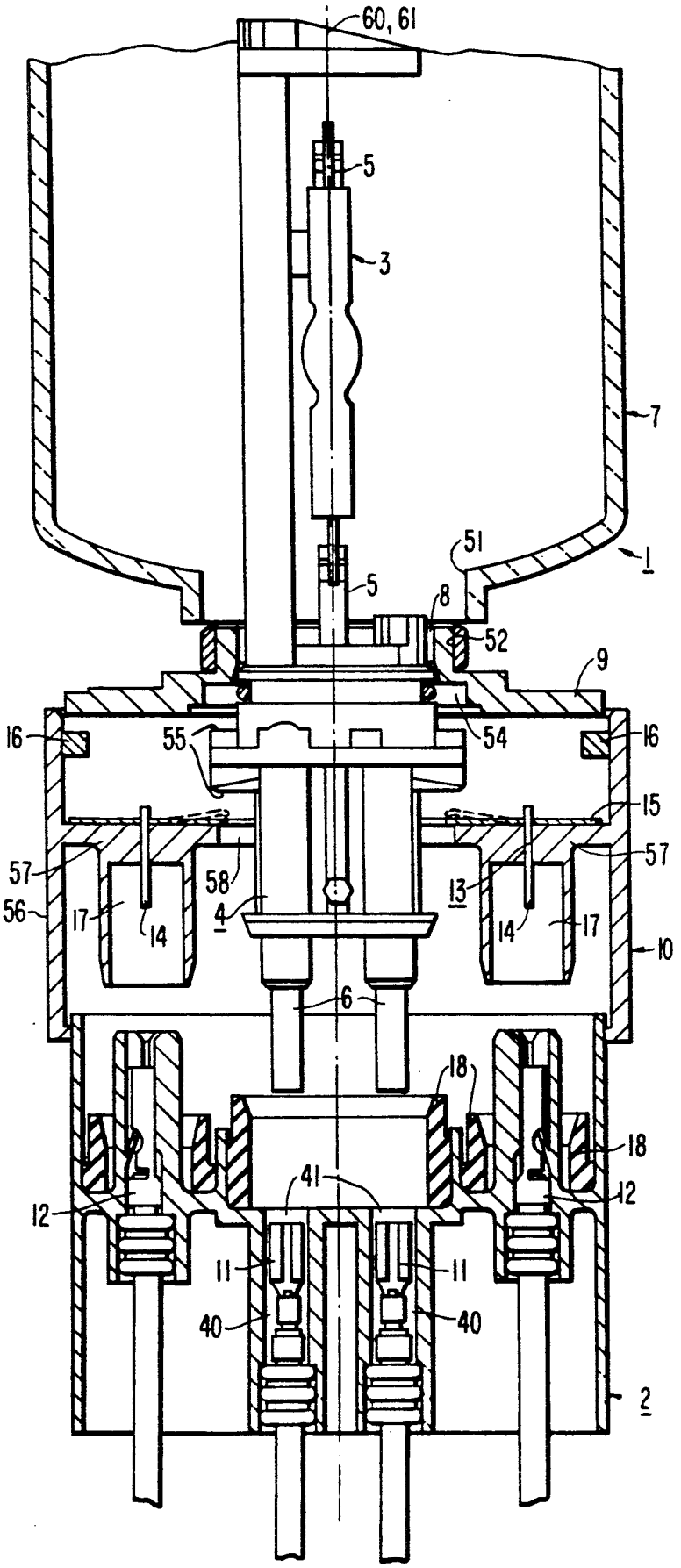
FIG. 4 is an exploded view of the lamp, reflector, and socket assembly shown in FIG. 1.

The connector or socket 2 has main contacts 11 for connection of the discharge lamp energizing to a lamp circuit when the main contacts 11 of the connector 2 are arranged against the contacts 6 at the lamp cap 4. Each contact 11 is disposed in a respective recess 40 and below the opening 41 of the recess as shown in FIG. 4.

The connector or socket 2 has additional contacts 12 adapted to be included in a low-voltage circuit feeding the lamp circuit. The headlight 1 has beside the lamp cap 4 a contact member 13, which electrically interconnects the additional contacts 12 of the connector or socket 2 when the main contacts 11 of the connector or socket 2 are arranged against the contacts 6 of the lamp cap 4.

In the embodiments shown, the contact member 13 comprises two contact parts 14 in the form of metal strips, which are interconnected by means of a metal annular disk 15. The contact member 13 is therefore electrically conducting and is electrically included in the circuit through the additional contacts 12. The contact member 13 has an individual contact part 14 for each additional contact 12 of the connector or socket 2. The contact member 13 is present in the fixing member 10.

The reflector 7 has an aperture 51 for receiving the cylindrical portion 52 of the circular planar member 9. (FIG. 4) The lamp cap 4 has a shoulder 55 which cooperates with shoulder 54 of the circular planar member 9 to determine the position of the lamp cap with respect to the circular planar member 9 and reflector 7. When the assembly 1 is mounted, the electrical discharge device 3 is introduced through the opening 8 inside the reflector 7 so that the opening 8 receives the lamp cap 4. The fixing member or annular body 10 is then provided, which has a circular tubular portion 56 and transverse planar portion 57. The transverse portion 57 has an aperture 58 which is large enough for allowing the lamp cap to be inserted from its end having the contacts 5 and small enough so that the lamp cap shoulder 55 butts against the transverse portion 57 adjacent the aperture 58. The annular body 10 first performing a translation to the reflector 7 and the lamp cap 4 and then a rotation, cams 16 then engaging behind the fixing means 9. It is not until then that the contacts 6 at the lamp cap 4 and the contact strips 14 of the contact member 13 in the fixing member 10 are in a configuration corresponding to the configuration of the main contacts 11 and the additional contacts 12 of the connector or socket 2.

When the connector or socket 2 is placed on the headlight 1, the contacts 6 at the lamp cap 4 are simultaneously connected to an energizing circuit and the additional contacts 12 of the connector or socket 2 are interconnected so that a low-voltage circuit is closed which feeds the lamp energizing circuit thus enabling the energizing circuit. When the contact member 13 does not engage into the connector or socket 2 the energizing circuit is disabled and the main contacts 11 and hence the discharge device 3 do not carry a high voltage.

An attractive property of the assembly shown is that an electric switch with movable parts is present neither in the connector or socket 2 nor at the headlight 1. A small elastic deformation of the main contacts 11 and the additional contacts 12 when they are in contact with the contacts 6 and with the contact member 13, respectively, is left out of consideration here.

It is also favorable that the additional contacts 12 are arranged in an individual cavity 17 in the connector or socket 2 so as to be spatially separated from each other. Washers are designated by reference numeral 18.

Figure 2:
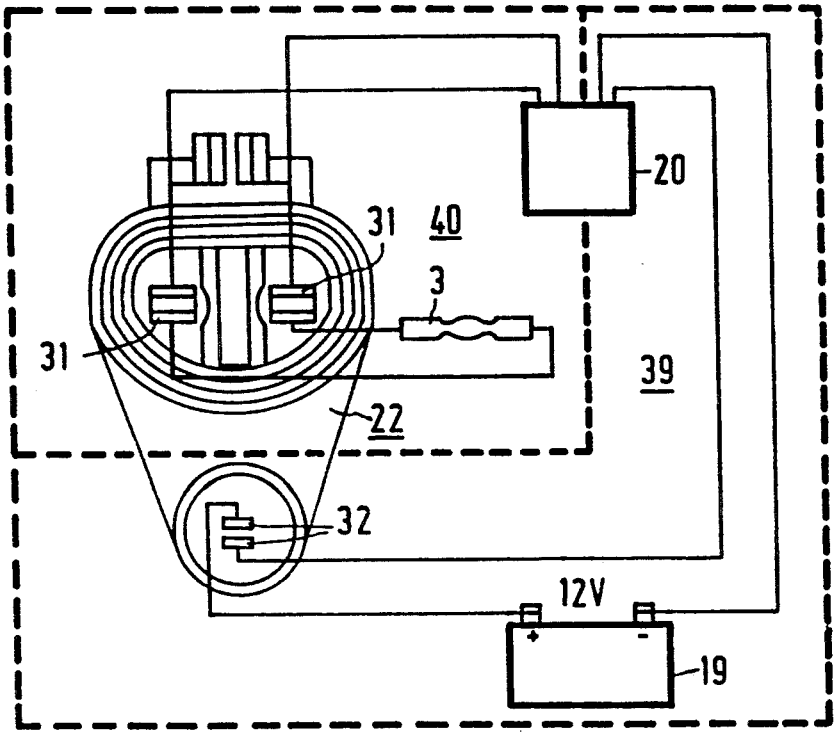
FIG. 2 is a front elevation of a connector for a second embodiment in an electric circuit.

FIG. 2 shows a connector 22 of a second embodiment in front elevation, as well as a voltage source 19 and a high-voltage supply apparatus, or energizing circuit 20. The high-voltage energizing circuit 20 is included together with the voltage source 19 in a low-voltage circuit 39, which is opened due to the fact that additional contacts 32 of the socket 2 are not interconnected. The energizing circuit is thus disabled. It is not until the additional contacts 32 are interconnected by means of a contact member 33 (FIG. 3) that the high-voltage supply apparatus, or energizing circuits, 20 is excited or enabled and a high voltage is applied across the main contacts 31 of the connector 22 which are included together with the lamp 3 in a lamp circuit 40.

Figure 3:
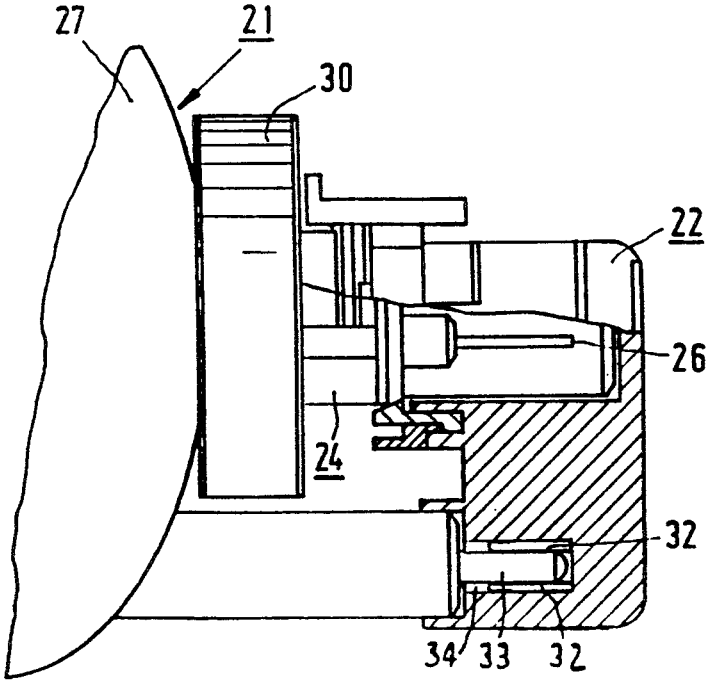
FIG. 3 is a side elevation of the second embodiment of an assembly, in which the connector is shown partly broken away and partly in longitudinal sectional view.

FIG. 3 shows that the additional contacts 32 are disposed in a recess 34 and are interconnected by means of the contact member 33, which is present at the reflector 27, at the instant at which the socket 22 is placed on the lamp cap 24. The contact member 33 is then connected electrically in series with the additional contacts 32, just like the contact member 13 with the additional contacts 12 in FIG. 1. The lamp cap 24 has a contact 26 and is held in the reflector 27 by a fixing member 30. The lamp cap 24, the reflector 27 and the fixing member 30 form part of a headlight 21.

What is claimed is:

1. An automotive lighting system, comprising:

a discharge lamp comprising a discharge device, a lamp cap having a pair of parallel cylindrical lamp contacts extending therefrom, and a pair of current supply conductors each connected to said discharge device and a respective lamp contact;

a socket for connection with said lamp cap, said socket comprising a first pair of fixedly spaced socket contacts positioned for contacting a respective lamp cap contact when said socket engages said lamp cap to establish a first conductive path from one of said first socket contacts, through its respective lamp cap contact, continuing through a respective current supply conductor to said discharge device and from said discharge device through the other current supply conductor to the other lamp cap contact and its respective first socket contact, and a second pair of contacts which are recessed and fixedly spaced from each other;

an energizing circuit connected to said first socket contacts for energizing said discharge device, said energizing circuit being connected to said discharge device through said first conductive path when said first socket contacts are in contact with said lamp cap contacts;

a low voltage circuit for feeding said energizing circuit which comprises said second pair of socket contacts, said second pair of contacts defining a normally open circuit discontinuity in said low voltage circuit such that said energizing circuit is disabled and no voltage is applied across said first socket contacts when said lamp cap contacts are not in contact with said first pair of socket contacts; and means for electrically bridging said spaced second contacts to close said circuit discontinuity in said low voltage circuit and enable said energizing circuit only when said lamp cap contacts are in contact with said first socket contacts, thereby defining a second conductive path which extends from one of said second socket contacts, through said means for electrically bridging, and ending at the other of said second contacts.

2. An automotive lighting system as claimed in claim 1, wherein said lighting system further comprises a reflector having an aperture through which said discharge lamp extends and means for securing said lamp with respect to said reflector.

3. An automotive lighting system as claimed in claim 2, wherein said spaced second socket contacts are arranged proximate each other in a single recess of said socket, and said means for electrically bridging said second contacts comprises a conductor positioned with respect to said reflector such that said conductor contacts each second socket contact when said socket engages said lamp cap and said lamp cap contacts are in contact with said first socket contacts.

4. An automotive lighting system as claimed in claim 3, wherein said socket comprises a portion having a pair of recesses each aligned with a respective lamp cap contact and having an opening opposing a respective lamp cap contact, and each first socket contact being secured in a respective recess below the opening of each respective recess, each lamp cap contact protruding into a respective recess and contacting a respective first socket contact when said socket engages said lamp cap.

5. An automotive lighting system as claimed in claim 2, wherein said means for securing said lamp cap with respect to said reflector comprises a body encircling a portion of said lamp cap for cooperating with said reflector and said lamp cap to secure said lamp cap in said reflector aperture, said second socket contacts being arranged in respective recesses in said socket in an annular region which surrounds said first socket contacts, and said means for electrically bridging said second socket contacts comprise a pair of contacts electrically connected to each other and arranged in said body for contacting a respective second socket contact when said lamp is secured in said reflector aperture and said lamp cap contacts are in contact with said first socket contacts.

6. An automotive lighting system as claimed in claim 5, wherein said socket comprises a portion having a pair of recesses each aligned with a respective lamp cap contact and having an opening opposing a respective lamp cap contact, and each first socket contact being secured in a respective recess below the opening of each respective recess, each lamp cap contact protruding into a respective recess and contacting a respective first socket contact when said socket engages said lamp cap.

7. An automotive headlamp assembly, comprising:

a discharge lamp comprising a discharge device defining a lamp axis, a lamp cap having a pair of parallel cylindrical lamp contacts extending therefrom, and a pair of current supply conductors each connected to said discharge device and a respective lamp contact;

a reflector having an optical axis and an aperture for receiving said lamp;

means for securing said lamp in said reflector aperture with said discharge device aligned with said optical axis;

an annular body encircling a portion of said lamp cap having a pair of spaced contacts and means for electrically connecting said spaced contacts to each other; and a socket for connection with said lamp cap, said socket comprising a first pair of socket contacts each being positioned for contacting a respective lamp cap contact when said socket engages said lamp cap thereby defining a first conductive path extending from one of said first socket contacts, through its respective lamp cap contact, continuing through a respective current supply conductor to said discharge device and from said discharge device through the other current supply conductor to the other lamp cap contact and its respective first socket contact, and a second pair of contacts which are recessed and spaced from each other to define an electrical discontinuity between said second contacts each arranged in said socket to contact a respective one of said spaced contacts on said annular body when said first socket contacts engage said lamp cap contacts thereby defining a second conductive path extending from one of said second socket contacts through a respective contact on said annular body, through the other contact on said annular body to the other second socket contact.

8. A headlamp assembly as claimed in claim 7, wherein said means for securing said lamp to said reflector comprises:

a circular planar member secured to said reflector having a cylindrical portion extending into said reflector aperture, a second aperture extending through said cylindrical portion for receiving said lamp cap, and a first shoulder adjacent said second aperture;

said lamp cap having a second shoulder near its end proximate said discharge device for butting against said first shoulder and determining the position of said discharge device with respect to said reflector; and an annular body for securing said lamp cap against said circular planar member comprising a circular tubular portion with an inner wall, a planar portion transverse to said tubular portion having a third aperture centered with respect to said tubular portion and sized large enough so that said lamp cap passes through said third aperture from its end having said lamp cap contacts to said lamp cap shoulder and small enough so that said lamp cap shoulder butts against said transverse portion adjacent said third aperture, and a plurality of cams symmetrically disposed around the inner wall of said tubular portion near its end proximate said reflector, said transverse portion of said annular body being spaced from said cams so that upon axial translation of said cams past said planar portion in the direction of said reflector and upon subsequent rotation of said annular body, said cams cooperate with said planar portion to urge said transverse portion against said lamp cap shoulder biasing said lamp cap shoulder against said first shoulder on said circular planar member and securing said lamp with respect to said reflector.

9. A headlamp assembly as claimed in claim 8, wherein said spaced contacts of said annular body are pin shaped and extend through and are supported by said flat transverse portion, and said means for electrically connecting said spaced contacts comprises a conductive material disposed on said transverse portion connecting each of said pin shaped contacts, said pin shaped contacts being arranged in said body so that their position for connection with a respective second socket contact is determined upon rotation of said annular body to secure said lamp in said reflector.

10. A headlamp assembly as claimed in claim 9, wherein said lamp cap contacts extend parallel to and are symmetric with said lamp axis defined by said discharge device.

11. A headlamp assembly as claimed in claim 10, wherein said socket comprises a portion having a pair of recesses each aligned with a respective lamp cap contact and having an opening opposing a respective lamp cap contact, and each first socket contact being secured in a respective recess below the opening of each said recess, each lamp cap contact protruding into a respective recess and contacting a respective first socket contact when said socket engages said lamp cap.

12. A headlamp assembly as claimed in claim 8, wherein said lamp cap contacts are extend parallel to and are symmetric with said lamp axis defined by said discharge device.

13. An automotive headlamp assembly, comprising:

a discharge lamp comprising a discharge device defining a lamp axis, a lamp cap having a pair of parallel cylindrical lamp contacts extending therefrom, and a pair of current supply conductors each connected to said discharge device and a respective lamp contact;

a reflector having an optical axis and an aperture for receiving said lamp;

means for securing said lamp in said reflector aperture with said discharge device aligned with said optical axis; and a socket for connection with said lamp cap, said socket comprising a first pair of socket contacts each being spaced for contacting a respective lamp cap contact when said socket engages said lamp cap thereby defining a first conductive path extending from one of said first socket contacts, through its respective lamp cap contact, continuing through a respective current supply conductor to said discharge device and from the discharge device through the other current supply conductor to the other lamp cap contact and its respective first socket contact, and a second pair of contacts which are recessed and arranged proximate each other and spaced for defining an electrical discontinuity between said second contacts; and a conductor for electrically bridging said electrical discontinuity, said conductor being fixed with respect to said reflector and positioned such that when said socket engages said lamp cap and each lamp cap contact is in contact with a respective first socket contact, said conductor contacts each of said spaced second socket contacts to establish a conductive path from one of said second contacts through said conductor and to the other of said second contacts.

14. A headlamp assembly as claimed in claim 13, wherein said means for securing said lamp to said reflector comprises:

a circular planar member secured to said reflector having a cylindrical portion extending into said reflector aperture, a second aperture extending through said cylindrical portion for receiving said lamp cap, and a first shoulder adjacent said second aperture;

said lamp cap having a second shoulder near its end proximate said discharge device for butting against said first shoulder and determining the position of said discharge vessel with respect to said reflector; and an annular body comprising a circular tubular portion having an inner wall, a planar portion transverse to said tubular portion having a third aperture centered with respect to said tubular portion and sized large enough so that said lamp cap passes through said third aperture from its end having said lamp cap contacts to said lamp cap shoulder and small enough so that said lamp cap shoulder butts against said transverse portion in a region adjacent said third aperture, and a plurality of cams symmetrically disposed around the inner wall of said tubular portion near its end proximate said reflector, said transverse portion of said annular body being spaced from said cams so that upon axial translation of said cams past said planar portion in the direction of said reflector and upon subsequent rotation of said annular body said cams cooperate with said planar portion to urge said transverse portion against said lamp cap shoulder biasing said lamp cap shoulder against said first shoulder on said circular planar member to secure said lamp cap with respect to said reflector.

15. A lamp assembly as claimed in claim 14, wherein said conductor for electrically bridging said spaced second contacts is supported on a support which is fixed to said reflector and extends adjacent said annular body.

16. A headlamp assembly as claimed in claim 15, wherein said lamp cap contacts are extend parallel to and are symmetric with said lamp axis defined by said discharge device.

17. A headlamp assembly as claimed in claim 16, wherein said socket comprises a portion having a pair of recesses each aligned with a respective lamp cap contact and having an opening opposing a respective lamp cap contact, and each first socket contact being secured in a respective recess below the opening of each respective recess, each lamp cap contact protruding into a respective recess and contacting a respective first socket contact when said socket engages said lamp cap.

* * * * *